US011637398B2

(12) United States Patent
Strahl

(10) Patent No.: US 11,637,398 B2
(45) Date of Patent: Apr. 25, 2023

(54) ELECTRICAL CONNECTOR WITH FULL-MATE INDICATOR

(71) Applicant: Amphenol Corporation, Wallingford, CT (US)

(72) Inventor: Erik Strahl, Unadilla, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 17/379,196

(22) Filed: Jul. 19, 2021

(65) Prior Publication Data

US 2023/0013185 A1 Jan. 19, 2023

(51) Int. Cl.

| | |
|---|---|
| ***H01R 13/623*** | (2006.01) |
| ***H01R 4/30*** | (2006.01) |
| ***H01R 13/641*** | (2006.01) |

(52) U.S. Cl.

CPC ..... *H01R 13/623* (2013.01); *H01R 4/304* (2013.01); *H01R 13/641* (2013.01)

(58) Field of Classification Search

CPC ..... H01R 13/623

See application file for complete search history.

(56) References Cited

U.S. PATENT DOCUMENTS

| | | | |
|---|---|---|---|
| 4,289,368 | A | 9/1981 | Schildkraut |
| 4,290,662 | A | 9/1981 | Storcel |
| 4,373,770 | A | 2/1983 | Raux et al. |
| 4,443,052 | A | 4/1984 | Eaby et al. |
| 4,534,607 | A | 8/1985 | Tomsa |
| 4,596,431 | A | 6/1986 | Burns |
| 5,322,451 | A | 6/1994 | Guss, III et al. |
| 6,811,423 | B2 | 11/2004 | Yoshigi et al. |
| 7,931,490 | B2 | 4/2011 | Pellen |
| 9,437,965 | B2 | 9/2016 | Zitsch et al. |
| 10,381,782 | B2 | 8/2019 | Byrne et al. |
| 2014/0004738 | A1 | 1/2014 | Thoerner et al. |

FOREIGN PATENT DOCUMENTS

| | | | |
|---|---|---|---|
| CA | 1108713 | A1 | 9/1981 |
| WO | WO 2008/098805 | A1 | 8/2008 |

*Primary Examiner* — Ross N Gushi

(74) *Attorney, Agent, or Firm* — Cantor Colburn LLP

(57) ABSTRACT

An electrical connector includes a connector shell, a coupling nut, and an indicator surrounding the connector shell. The indicator includes a clamp member and a check member. The clamp member includes a ring and a coupling structure extending from the ring to the check member and coupling the ring to the check member. The indicator may assist a user in determining if the electrical connector is in a fully-mated state.

20 Claims, 10 Drawing Sheets

ELECTRICAL CONNECTOR WITH FULL-MATE INDICATOR

BACKGROUND

The disclosure relates generally to the field of electrical connectors and more particularly to an electrical connector with a full-mate Indicator.

Electrical connectors have a wide range of applications. Certain electrical connector pairs may include a first connector having a threaded coupling nut and a second mating connector, and the two connectors can be coupled by means of rotating the threaded coupling nut. When torque for coupling the connectors is high, it can be difficult to determine at what point the connector pair is fully mated.

SUMMARY

An aspect of this disclosure is an electrical connector that includes a connector shell; a coupling nut configured to at least partially surround the connector shell, where the coupling nut includes a first end and a second opposing end, and the first end is configured to interface with a mating connector; and an indicator including a clamp member and a check member coupled to the clamp member. The check member is external to the second end of the coupling nut, and the clamp member extends from an inner location inside the coupling nut to the check member external to the second end of the coupling nut.

In certain examples, the clamp member includes a ring and a coupling structure extending from the ring to the check member and coupling the ring to the check member.

In some examples, the ring is circular or approximately circular.

In other examples, the ring has a split portion.

In yet another example, the connector shell includes a shoulder having a pinching surface facing towards the mating connector. The ring is directly adjacent to the pinching surface of the shoulder.

In certain examples, the check member includes a first slot and a second slot. The coupling structure includes first and second projection structures each having an end portion and a neck portion. The first slot of the check member is coupled to the first projection structure, and the second slot of the check member is coupled to the second projection structure.

In some examples, the end portion of the first projection structure has a larger width than the first slot of the check member. The neck portion of the first projection structure has a smaller width than the first slot of the check member.

In other examples, the second end of the coupling nut includes a first slot corresponding to the first projection structure and a second slot corresponding to the second projection structure.

In yet another example, the first slot of the second end of the coupling nut has a larger width than the end portion of the first projection structure.

Another aspect of this disclosure is an electrical connector assembly that includes a first electrical connector and a second electrical connector configured to mate with the first electrical connector, wherein first electrical connector includes a connector shell; a coupling nut configured to at least partially surround the connector shell, where the coupling nut includes a first end and a second opposing end; and an indicator including a clamp member and a check member coupled to the clamp member. The check member is external to the second end of the coupling nut. The clamp member extends from an inner location inside the coupling nut to the check member external to the second end of the coupling nut.

In certain examples, the clamp member includes a ring and a coupling structure extending from the ring to the check member and coupling the ring to the check member In some examples, the ring is circular or approximately circular.

In other examples, the ring has a split portion.

In yet another example, the connector shell includes a shoulder having a leading surface facing towards the mating connector; and the ring is directly adjacent to the leading surface of the shoulder.

In certain examples, the check member includes a first slot and a second slot; the coupling structure includes first and second projection structures each having an end portion and a neck portion; and the first slot of the check member is coupled to the first projection structure, and the second slot of the check member is coupled to the second projection structure.

In some examples, the indicator is configured to be in a non-rotatable state when the first and second electrical connectors are in a fully-mated state, and in a rotatable state when the first and second electrical connectors are not in a fully-mated state.

In other examples, the clamp member includes a ring and a coupling structure extending from the ring to the check member and coupling the ring to the check member. The connector shell of the first electrical connector includes a shoulder having a first pinching surface facing towards the second electrical connector. The second electrical connector includes a second pinching surface facing towards the first pinching surface; and the ring is pinched between and in contact with the first and second pinching surfaces when the first and second electrical connectors are in a fully-mated state.

Yet another aspect of this disclosure is an electrical connector that includes a connector shell and an indicator surrounding the connector shell. The indicator includes a clamp member and a check member coupled to the clamp member. The clamp member includes a ring and a coupling structure extending from the ring to the check member and coupling the ring to the check member.

In certain examples, the connector shell includes a shoulder having a pinching surface; and the ring is directly adjacent to the pinching surface of the shoulder.

In some examples, the check member includes a first slot and a second slot. The coupling structure includes first and second projection structures each having an end portion and a neck portion. The first slot of the check member is coupled to the first projection structure, and the second slot of the check member is coupled to the second projection structure.

This summary is not intended to identify essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE FIGURES

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

Figure 1:
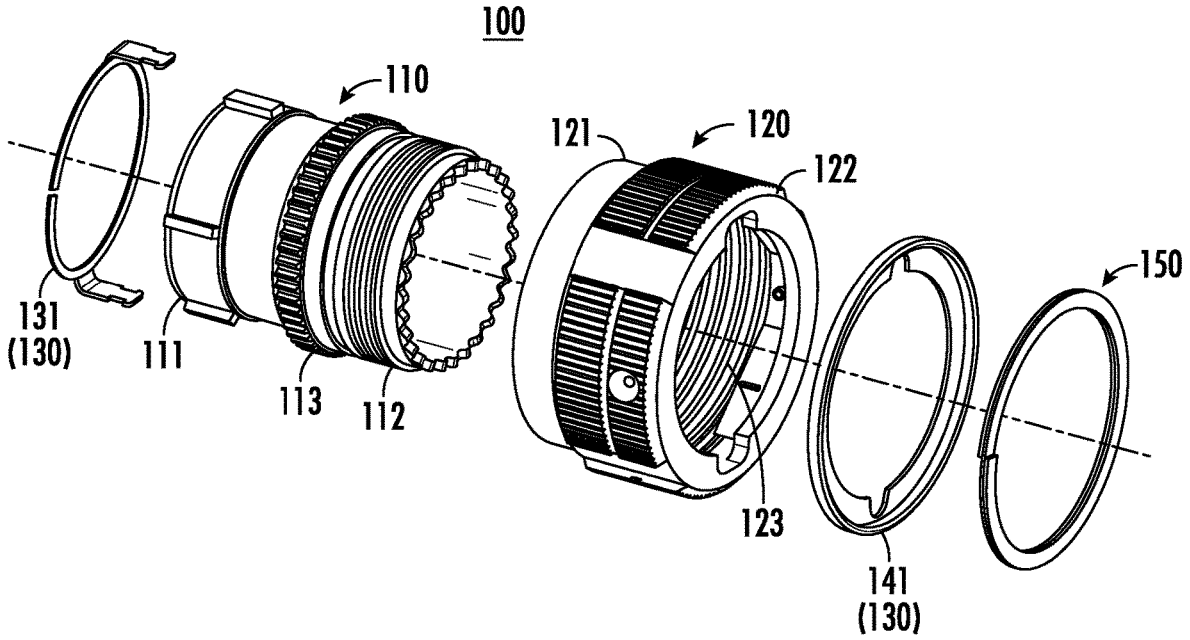
FIG. 1 illustrates an exploded view of an exemplary electrical connector according to an example of the present disclosure.

Examples disclosed include an electrical connector that includes a connector shell (or connector body); a coupling nut configured to at least partially surround the connector shell, where the coupling nut includes a first end and a second opposing end, and the first end is configured to interface with a mating connector; and an indicator that may include a clamp member and a check member coupled to the clamp member. The check member is external to the second end of the coupling nut, and the clamp member extends from an inner location inside the coupling nut to the check member external to the second end of the coupling nut.

When torque for coupling the connectors is high, it can be difficult to determine at what point the connector pair is fully mated based on the torque for coupling the connectors. The indicator of the present disclosure can check, determine, or confirm whether the electrical connector is in a fully-mated state (i.e., full-mate state) with respect to a corresponding mating connector. In some examples, for instance, the indicator is rotatable when the electrical connector is in an unmated position or a partially-mated position, and the indicator is stationary (not rotatable) when the electrical connector is in a fully-mated position. In some examples, at least a portion of the indicator is clamped between the connector body and the receptacle when the connector is in the fully-mated position such that the indicator is stationary or not rotatable. Accordingly, the indicator can assist a user in determining if the electrical connector is in a fully-mated position or state. An electrical connector in a fully-mated position or state can provide improved shield or protection against electro-magnetic interferences (EMI) and against corrosion of electrical pins and sockets of the electrical connector and the corresponding mating connector.

In certain examples, an electrical connector assembly includes a first electrical connector and a second electrical connector, wherein the first electrical connector includes a connector shell; a coupling nut configured to at least partially surround the connector shell, where the coupling nut includes a first end and a second opposing end; and an indicator including a clamp member and a check member coupled to the clamp member. The check member is external to the second end of the coupling nut, and the clamp member extends from an inner location inside the coupling nut to the check member external to the second end of the coupling nut; and a second electrical connector configured to mate with the first electrical connector. In some examples, the clamp member is compressed between the connector body and the receptacle when the connector is in the fully-mated position such that the check member is stationary or not rotatable. Thus, a user can determine whether the connector is in the fully-mated position by applying a rotation force (or torque) to the check member.

In another example, an electrical connector includes a connector shell and an indicator surrounding the connector shell. The indicator includes a clamp member and a check member coupled to the clamp member. The clamp member includes a ring and a coupling structure extending from the ring to the check member and coupling the ring to the check member.

FIG. 1 illustrates an exploded view of an exemplary electrical connector 100. FIGS. 2 to 6 illustrates perspective views of assembling the exemplary electrical connector 100. The electrical connector 100 (e.g., plug connector) includes a connector body (e.g., a connector shell) 110 and a coupling nut 120. The coupling nut 120 is configured to at least partially surround the connector body (e.g., a connector shell) 110, when the electrical connector 100 is assembled. The connector body 110 includes a front end 111 (e.g., a first end), a rear end 112 (e.g., a second end), and a shoulder 113. The coupling nut 120 includes a front end 121, a rear opposing end 122, and an inner thread portion 123 located between the front end 121 and rear end 122. The inner thread portion 123 includes inner threads configured to mate with outer threads of a mating connector (e.g., receptacle connector 200 in FIG. 8). The front end 121 of the coupling nut 120 may be configured to interface with a complementary electrical connector or a mating electrical connector (e.g., a receptable connector 200 in FIG. 8).

Figure 7:
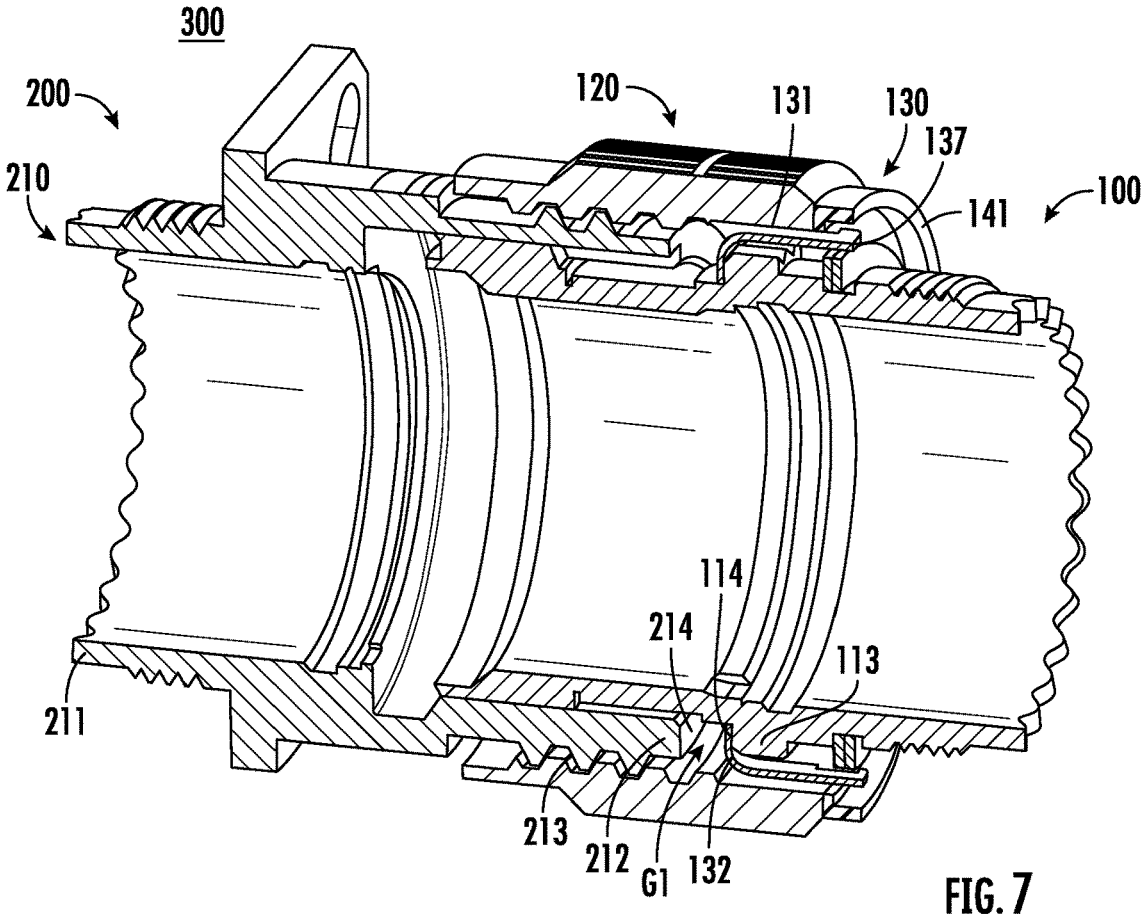
FIG. 7 is a perspective cross-sectional view of an electrical connector assembly including partially-mated first electrical connector and second electrical connector according to an example of the present disclosure.
Figure 8:
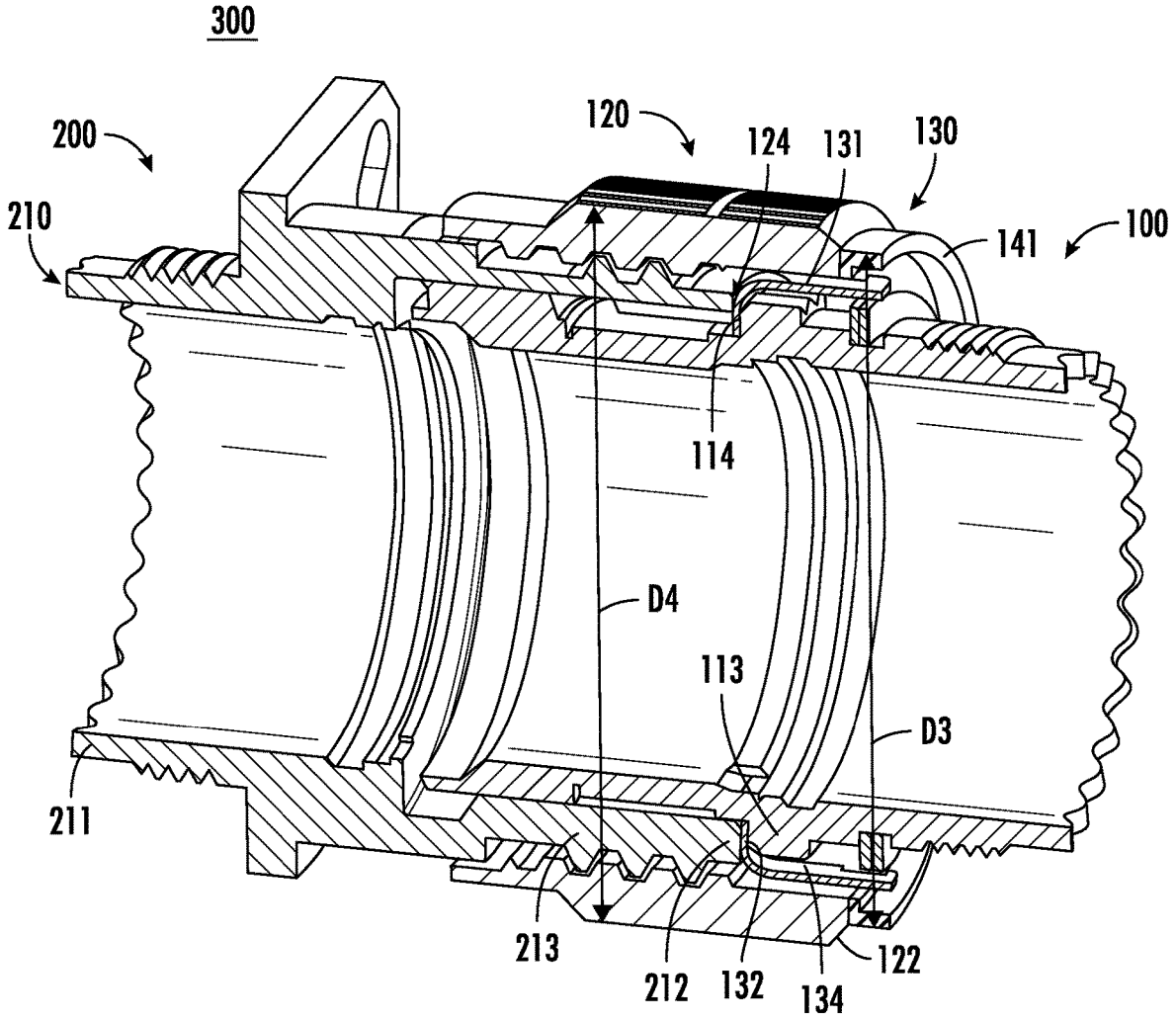
FIG. 8 is another perspective cross-sectional view of the electrical connector assembly illustrated in FIG. 7, including fully-mated first electrical connector and second electrical connector.

The electrical connector 100 further includes an indicator 130 configured to assist a user in determining a tightness of mating between the electrical connector 100 and the corresponding mating connector (e.g., a receptacle connector 200 in FIG. 8). For example, indicator 130 may be configured to assist a user in determining whether the electrical connector 100 is in a fully-mated state (i.e., full-mate state) with respect to the corresponding mating connector; and accordingly, in some examples, the indicator 130 is a full-mate indicator that determines whether the associated electrical connector (e.g., connector body 110 and coupling nut 120) is in a fully-mated state with respect to the mating connector (e.g., receptacle connector 200 in FIG. 8). The indicator 130 may include a clamp member 131 and a check member 141 coupled to the clamp member 131. In some examples, the clamp member 131 and the check member 141 are separate elements that are coupled together. In other examples, the clamp member 131 and the check member 141 are a unitary piece. The check member 141 is configured to be visible to and accessible (e.g., touchable) by the user of the connector 100, e.g. an installer, to readily indicate to the user whether the connector 100 is fully mated to the mating connector 200 (see e.g., FIG. 7 showing the connector in a partially mated position and FIG. 8 showing the connector in a fully mated position).

The electrical connector 100 further includes a retaining ring 150 configured to retain components (e.g., the coupling nut 120 and the check member 141) of the electrical connector 100 in place with respect to the connector body 110 when the electrical connector 100 is assembled. After the electrical connector 100 is assembled, the clamp member 131 is coupled to the check member 141, and accordingly, the clamp member 131 and the check member 141 rotate or remain stationary together. In some embodiments, the electrical connector 100 does not include a retaining ring 150 and the components are held together in another way, such as, but not limited to, a snap fit, friction fit, threading, or placement between coupled elements of the connector 100.

Figure 2:
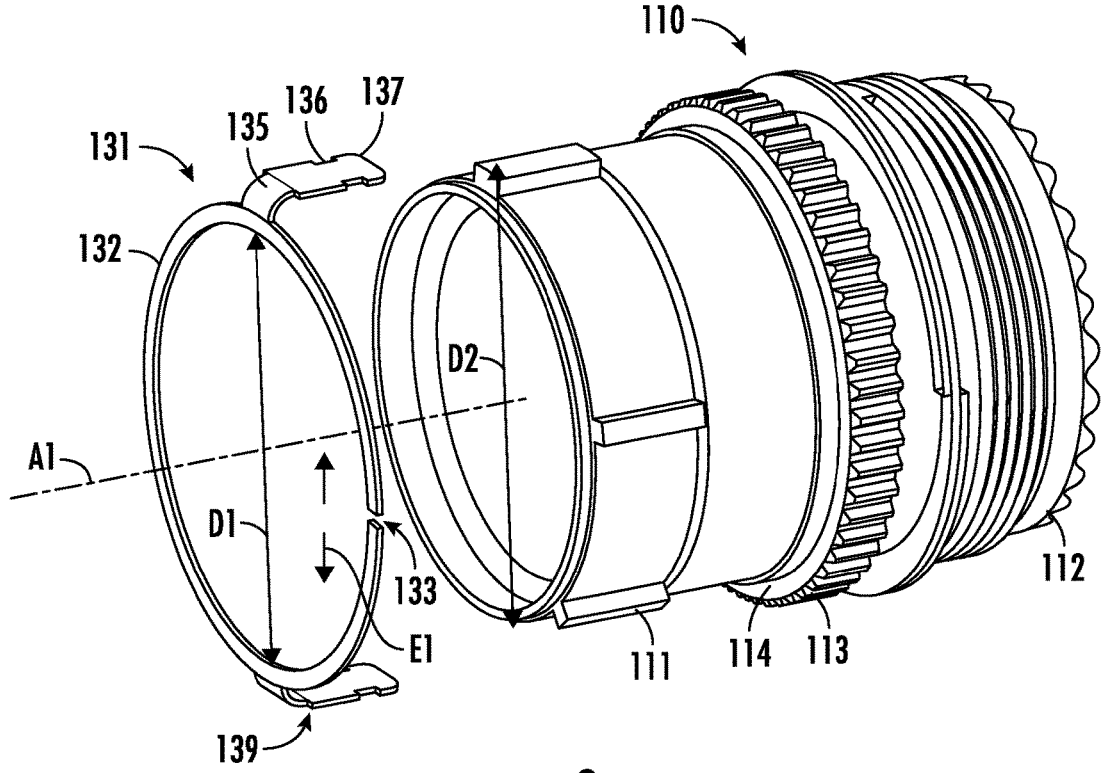
FIG. 2 is an exploded perspective view illustrating installation of a clamp member to a connector body of the electrical connector of FIG. 1.
Figure 3:
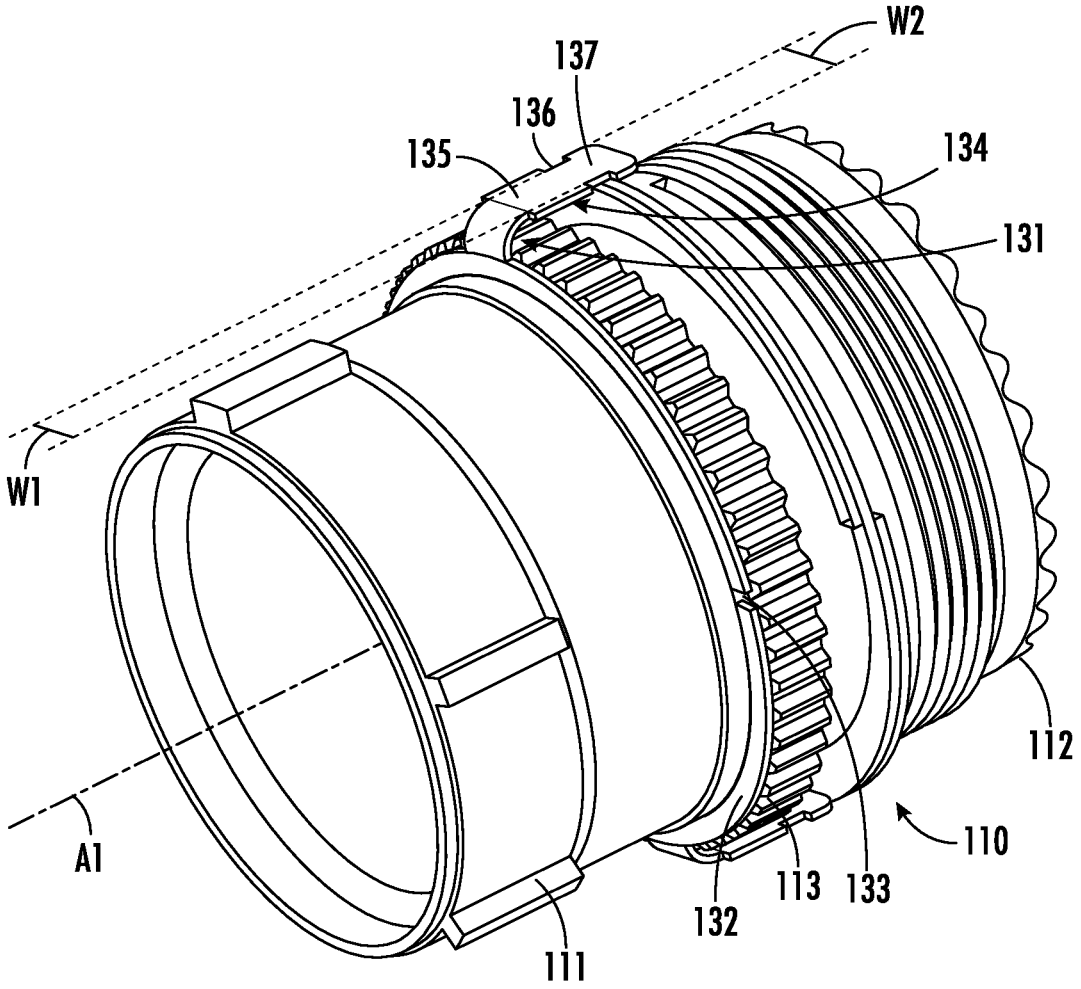
FIG. 3 is a perspective view of the connector body of FIG. 2 with the installed clamp member.

FIG. 2 illustrates installation of the clamp member 131 to the connector body 110. FIG. 3 illustrates the connector body 110 with installed clamp member 131. The clamp member 131 includes a clamp ring 132 and one or more projection structures or arms 134 extending from the clamp ring 132 along (or approximately along) an axial direction A1 of the clamp ring 132. The clamp ring 132 may be circular or approximately circular. For example, the clamp ring 132 may have an annular shape. In other examples, the clamp ring 132 may have an elliptical shape or other shape that is approximately circular. In certain examples, the clamp ring 132 may have a circular shape, a semicircular shape, a wave-spring shape, or may be shaped in any suitable way such that it projects onto or interface with the pinching surface 114 (e.g., circular or annular pinching surface).

Further, the clamp ring 132 includes a split portion 133 (see e.g., FIG. 2); and the split portion 133 of the clamp ring 132 allows the clamp ring 132 to expand, so as to clear portions (e.g., front end 111) of the connector body 110 when installing the clamp member 131 to the connector body 110. For example, the inner dimension D1 of the clamp ring 132 may be smaller than dimension D2 of the front end 111 of the connector body 110; and when installing the clamp member 131 to the connector body 110, the split portion 133 of the clamp ring 132 allows clamp ring 132 to expand as indicated by two arrows E1, such that the inner dimension of the clamp ring 132 may be increased to a value larger than dimension D2 of the front end 111 of the connector body 110. Accordingly, the front end 111 of the connector body 110 (such as keys or alignment structures of the front end 111) may not block the clamp ring 132, and the clamp ring 132 can be installed to the connector body 110. In some examples, the clamp ring 132 and projection structures 134 may be formed of metal (such as beryllium copper, stainless steel, aluminum, sheet metal, formed metal, machined metal), molded composite, or any other suitable materials.

The shoulder 113 includes a pinching surface 114 facing towards the mating connector and the front end 111 of the connector body 110. When installing the clamp member 131 to the connector body 110, the shoulder 113 blocks the clamp ring 132 from moving beyond the pinching surface 114. With the indicator 130 being installed to the connector body 110, the clamp ring 132 may be directly adjacent to the shoulder 113, and may be in contact with the pinching surface 114 of the shoulder 113 (See, e.g., FIG. 3).

In the examples of FIG. 2 and FIG. 3, the clamp ring 132 includes a split portion 133. In other examples, the clamp ring 132 may be a closed ring that is free of a split portion; and the clamp ring 132 and the front end 111 of the connector body 110 may be shaped and sized, such that indicator 130 can be installed to the connector body 110 without expanding the clamp ring 132. In certain examples, the clamp ring 132 may be a closed ring that is free of a split portion; and the closed ring may have cut patterns compatible with the shapes of the front end 111 of the connector body 110, such that indicator 130 can be installed to the connector body 110 without expanding the clamp ring 132. The clamp ring 132 can have other suitable shapes, such that indicator 130 can be installed to the connector body 110.

The one or more projection structures or arms 134 may form or serve as a coupling structure 139 that couples the clamp member 131 to the check member 141. The coupling structure 139 may extending from the clamp ring 132 to the check member 141 to couple the clamp ring 132 to the check member 141. Each projection structure 134 includes a proximal portion 135 that is proximal to the clamp ring 132, an end portion 137, and a neck portion 136 between the proximal portion 135 and the end portion 137. The neck portion 136 has a width W1 in a direction perpendicular to or approximately perpendicular to the axial direction A1 of the clamp ring 132. Referring momentarily to FIG. 3 in particular, the end portion 137 has a width W2 in a direction perpendicular to or approximately perpendicular to the axial direction A1 of the clamp ring 132. The width W1 of the neck portion 136 is smaller than the width W2 of the end portion 137, such that the projection structure 134 can have a snap fit with the respective slot 142 of the check member 141.

Figure 4:
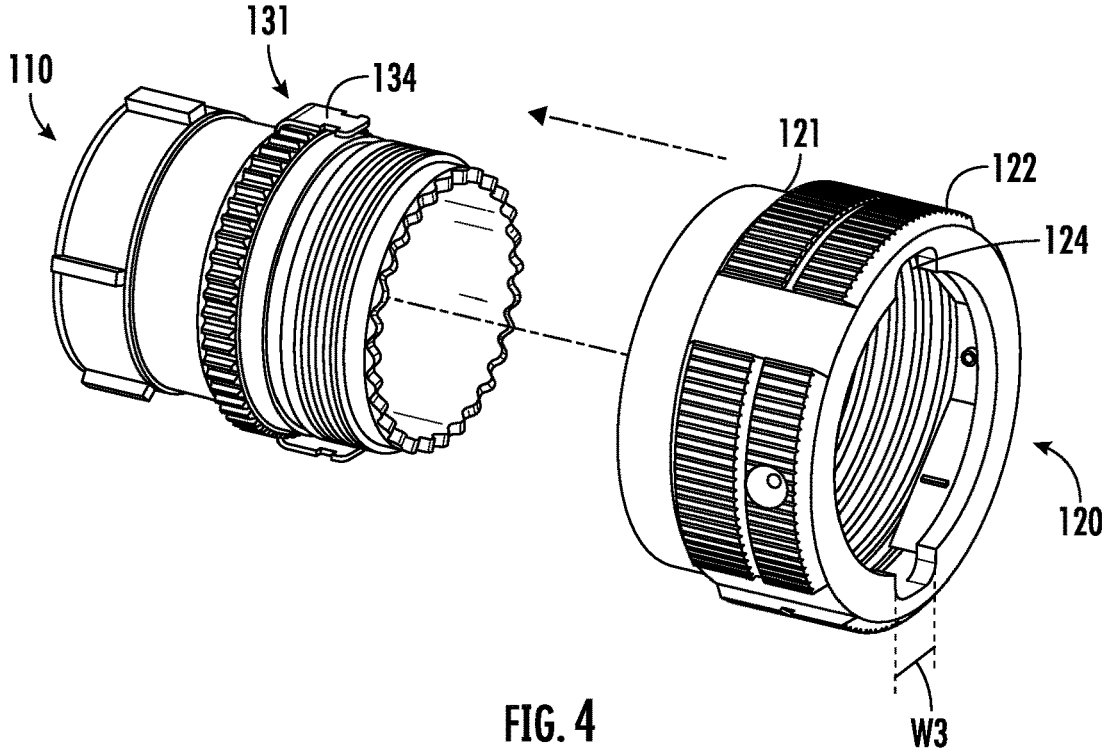
FIG. 4 is an exploded perspective view illustrating the installation of an example coupling nut to the connector body of FIG. 3.

FIG. 4 illustrates installing the coupling nut 120 to the connector body 110. The coupling nut 120 includes one or more clearance apertures 124 (e.g., clearance slots) at the rear end 122. The one or more clearance apertures 124 may correspond to the one or more projection structures 134, respectively. The clearance aperture 124 has a width W3. The widths W3 of the one or more clearance aperture 124 are larger than the widths W2 of the end portions 137 of the one or more projection structures 134 (FIGS. 3 and 4), respectively. Accordingly, after the electrical connector 100 is assembled (see e.g., FIGS. 7 and 8), the end portion 137 and at least part of the neck portion 136 extend out from the rear end 122 of the coupling nut 120; and further, the clearance aperture 124 provides clearance, such that the projection structure 134 can extend to the check member 141, and the indicator 130 may rotate under rotation force when the electrical connector 100 is not fully mated with a mating connector. In the examples of FIG. 4, when installing the coupling nut 120 to the connector body 110, the two clearance apertures 124 of the coupling nut 120 are aligned with the two projection structures 134, respectively; and the two clearance apertures 124 each allows passage of the end portion 137 and at least part of the neck portion 136 of the respective projection structure 134. In the present disclosure, the number of clearance apertures 124 of the coupling nut 120 and the number of projection structures or arms 134 may be chosen according to various application scenarios, and may be, for example, 3, 4, 5, or other suitable integers.

Figure 5:
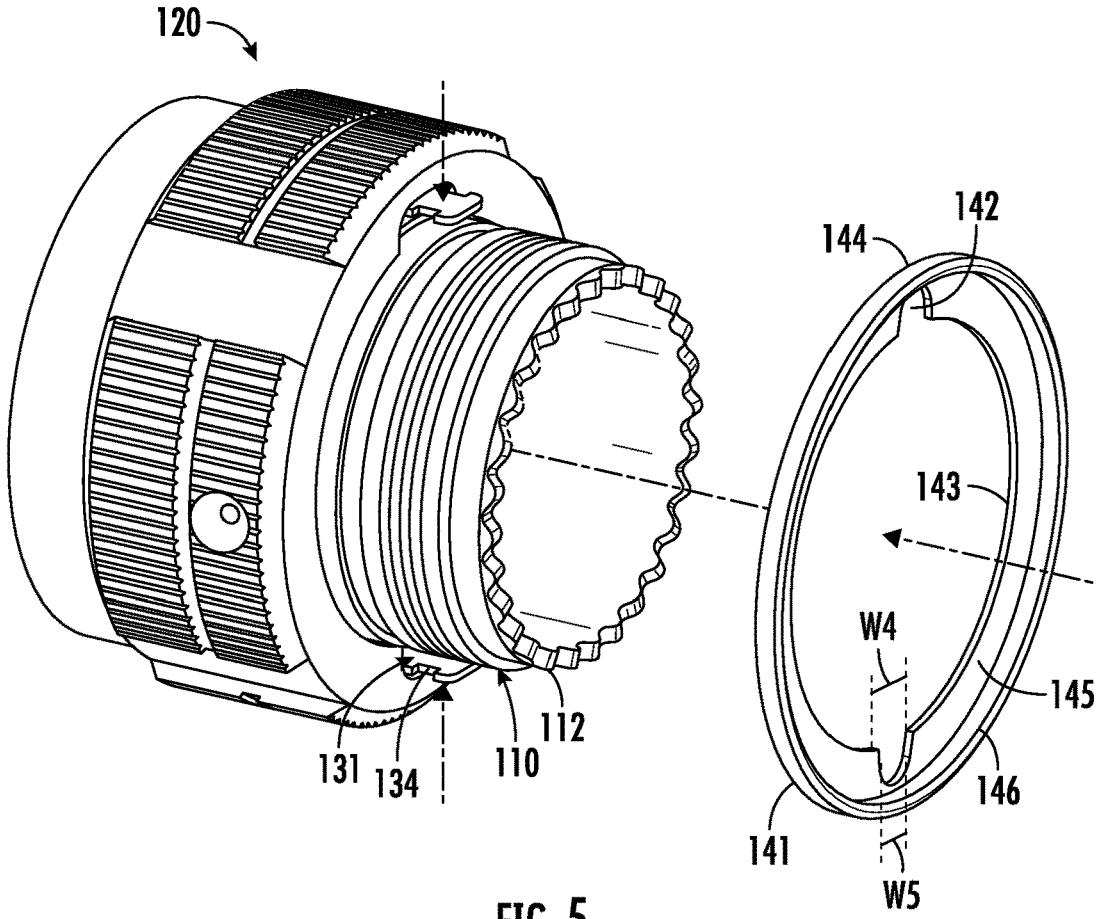
FIG. 5 is an exploded perspective view illustrating the coupling of an example check member to the clamp member of FIG. 4 to form an indicator surrounding the connector body.

FIG. 5 illustrates coupling the check member 141 to the projection structures or arms 134 of the clamp member 131 from the rear end 112 of the connector body 110. The check member 141 includes one or more slots 142. The projection structures 134 may have certain flexibility. The projection structures 134 may be pressed inward by applying pressing force, as indicated by dashed arrows near the projection structures 134 in FIG. 5, and may further snap into the slots 142 of the check member 141, as the check member 141 is moved towards the projection structures 134 of the clamp member 131, indicated by dashed arrows near the check member 141 in FIG. 5. Accordingly, as the pressing force on the projection structures 134 is released, the projection structures 134 return to or towards their original state, thereby coupling the check member 141 to the clamp member 131. Accordingly, the one or more slots 142 of the check member 141 are coupled to the one or more projection structures 134, respectively. The number of the slots 142 of the check member 141 may be chosen according to various application scenarios, and may be, for example, 3, 4, 5, or other suitable integers.

The check member 141 may have a ring or annular shape, and may have an inner periphery 143 and an outer periphery 144. The check member 141 may include a base 145 and a wall 146 at or near the outer periphery 144. The wall 146 has a larger height than the base 141 along the axial axis of the check member 141. The slot 142 of the check member 141 may have an inner width W4 (or dimension) at or near the inner periphery 143. Widths or dimensions of the slot 142 may be reduced along a direction pointing from the inner periphery 143 towards the outer periphery 144. For example, the width (or dimension) W5 is at a location that is closer to the outer periphery 144 than the inner periphery 143, and is smaller than inner width W4. In some examples, the inner width W4 of the slot 142 may be larger than the width W1 of the neck portion 136, and the width W5 of the slot 142 may be equal to or smaller than the width W1 of the neck portion 136, such that the neck portion 136 can stay in or be coupled to the respective slot 142. In some examples, the width W2 of the end portion 137 may be larger than a width of the slot 142 (such as the inner width W4 or the width W5), so as to prevent unintentional decoupling between the clamp member 131 and the check member 141.

In other examples, the projection structure 134, the clearance aperture 124 and the slot 142 may have other shapes, sizes and configurations that perform similar functions and fall within the scope of this disclosure. For example, the projection structure 134 may be triangular in shape with a pointed end that fits within slot 142, and slot 142 may have a corresponding shape to accept the triangular projection structure 134. Likewise, the projection structure 134 may have a rounded end in other examples. In addition, other features or methods may be used to secure the clamp member 131 to the check member 141, such as screwing, riveting, spot welding, soldering. In addition, the coupling between the clamp member 131 to the check member 141 may be permanent or removable.

Figure 6:
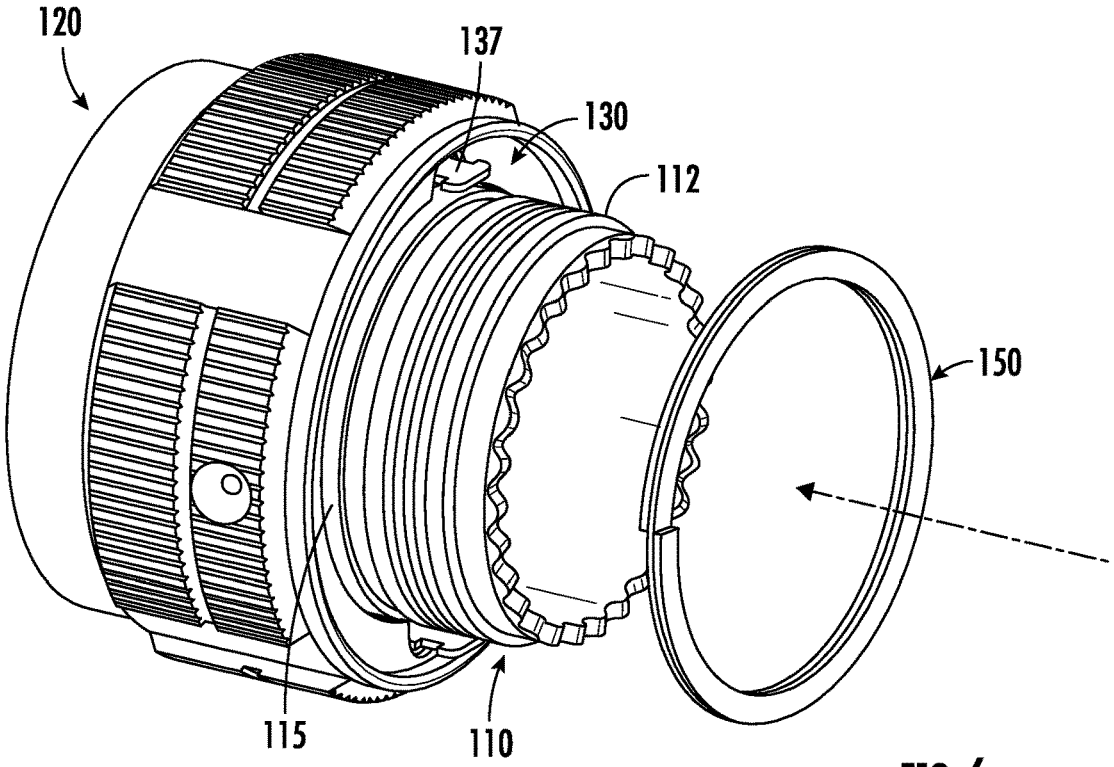
FIG. 6 is an exploded perspective view illustrating the installation of an example retaining ring on the connector body of FIG. 5.

FIG. 6 illustrates installing the retaining ring 150 to the connector body 110. The connector body 110 may further include an annular groove 115. The retaining ring 150 may be installed to the annular groove 115 from the rear end 112 of the connector body 110, so as to retain components (e.g., the coupling nut 120, the indicator 130) of the connector 100 in place (see, e.g., FIG. 7). The retaining ring 150 may have a diameter larger than a diameter of the inner periphery 143 of the check member 141, and smaller than a diameter of the outer periphery 144 of the check member 141. Accordingly, the retaining ring 150 can be installed inside the wall 146 of the check member 141 and against the base 145 of the check member 141, so as to keep the check member 141 in place.

In the assembled electrical connector 100, the clamp member 131 may be at least partially internal to the coupling nut 120. That is, in the assembled electrical connector 100, the clamp member 131 may have at least a portion (e.g., the clamp ring 132) inside or internal to the coupling nut 120. Further, the clamp member 131 may also have certain other portions (such as the end portion 137) that is external to the coupling nut 120, in order for the clamp member 131 to be coupled to the check member 141. The clamp ring 132 internal to the coupling nut 120 can be clamped or pinched by the pinching surface 114 of the electrical connector 100 and a corresponding mating connector, when the electrical connector 100 is in a fully-mated state. Accordingly, a user can access the check member 141 that is external to the coupling nut 120 to check whether the clamp ring 132 internal to the coupling nut 120 is clamped or pinched by the pinching surface 114 of the electrical connector 100 and the corresponding mating connector, so as to determine whether the electrical connector 100 is in a fully-mated state. The indicator 130 may surround the connector body (e.g., a connector shell) 110.

FIG. 7 illustrates a cutaway view of an electrical connector assembly 300 including partially-mated electrical connector 100 and electrical connector 200. The mating electrical connector 200 (e.g., socket connector) includes a connector body 210 (e.g., a shell). The connector body 210 includes a rear end 211, a front end 212, a thread portion 213 including outer threads, and a pinching surface 214. The pinching surface 214 faces toward the electrical connector 100, when the two electrical connectors 100, 200 mates with each other to form the electrical connector assembly 300. When the electrical connector 100 is mated with the electrical connector 200, the coupling nut 120 of the electrical connector 100 is advanced over the outer threads of the thread portion 213 of the second electrical connector 200.

In the example of FIG. 7, the electrical connectors 100 and 200 are in a partially-mated state, instead of a fully-mated state. Accordingly, there is a gap G1 between the pinching surface 214 and the clamp ring 132, and the clamp ring 132 is not clamped or pinched by the pinching surface 114 of the electrical connector 100 and the pinching surface 214 of the electrical connector 200. A rotation force can be applied by the user to the check member 141 to check, determine, or confirm whether the electrical connectors 100 and 200 are in the fully-mated state. If the check member 141 rotates or can rotate, then the connectors 100 and 200 are not fully mated. The fully-mated state refers to a state in which mating of the electrical connectors 100 and 200 is completed. The partially-mated state refers to a state in which mating of the electrical connectors 100 and 200 has been started but is not completed. The unmated state refers to a state in which mating of the electrical connectors 100 and 200 has not been started, and the electrical connectors 100 and 200 are separate from each other. Because the check member 141 is coupled to the clamp ring 132 via the projection structures 134, the rotational force applied by the user to the check member 141 is transferred to the clamp ring 132 via the projection structures 134 such that the check member 141, the clamp ring 132, and the projection structures 134 rotate or remain stationary together.

When the electrical connectors 100 and 200 are not fully-mated, e.g., in a partially-mated state of FIG. 7 or an unmated state, the clamp ring 132 is not clamped or pinched, or is only partially clamped or pinched, by the pinching surface 114 of the electrical connector 100 and the pinching surface 214 of the electrical connector 200. Under rotation force applied by the user to the check member 141, the check member 141 rotates; and as the check member 141 is coupled to the clamp ring 132 via the projection structures 134, the clamp ring 132 and the projection structures 134 rotate together with the check member 141. Accordingly, the indicator 130 is in a rotatable state or is rotated from a first position to a second position with respect to the connector body 110, in response to the rotation force. In some example, the indicator 130 may be rotated by an angle in, e.g., a range of −4 degrees to +4 degrees with respect to the connector body 110, in response to the rotation force. The range of rotation angle can be configured by choosing suitable widths W3 of the clearance apertures 124 of the coupling nut 120 and suitable widths of the projection structures 134 such as widths W1 and W2.

Figure 9:
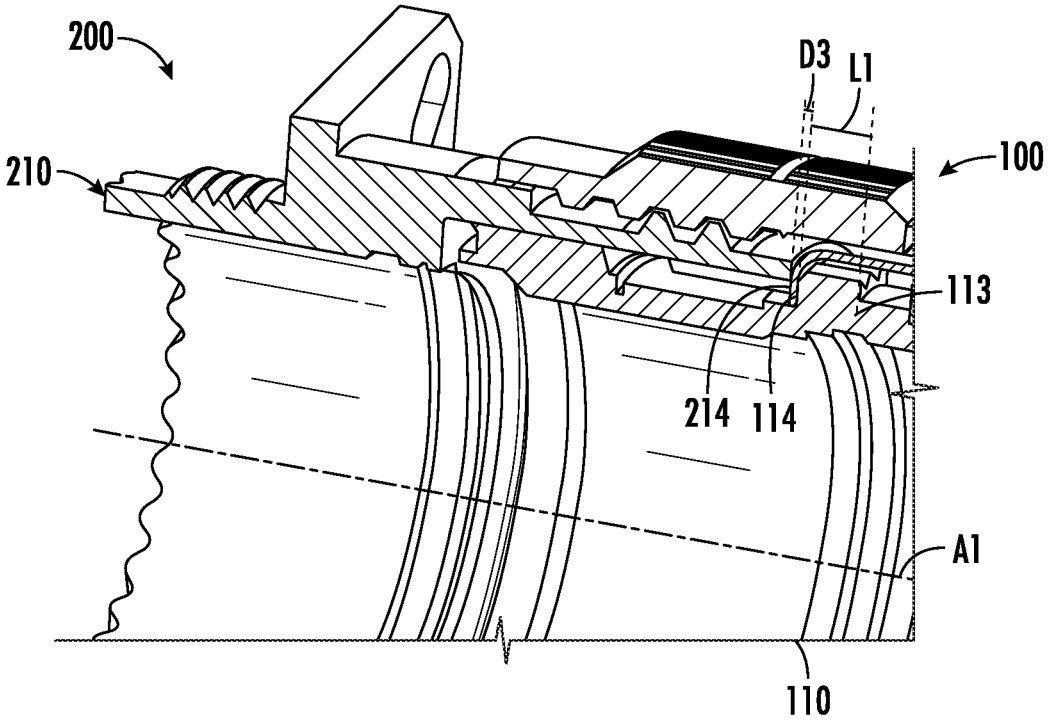
FIG. 9 is a partial cross-sectional view of a portion of the fully-mated electrical connector assembly of FIG. 8.
Figure 10:
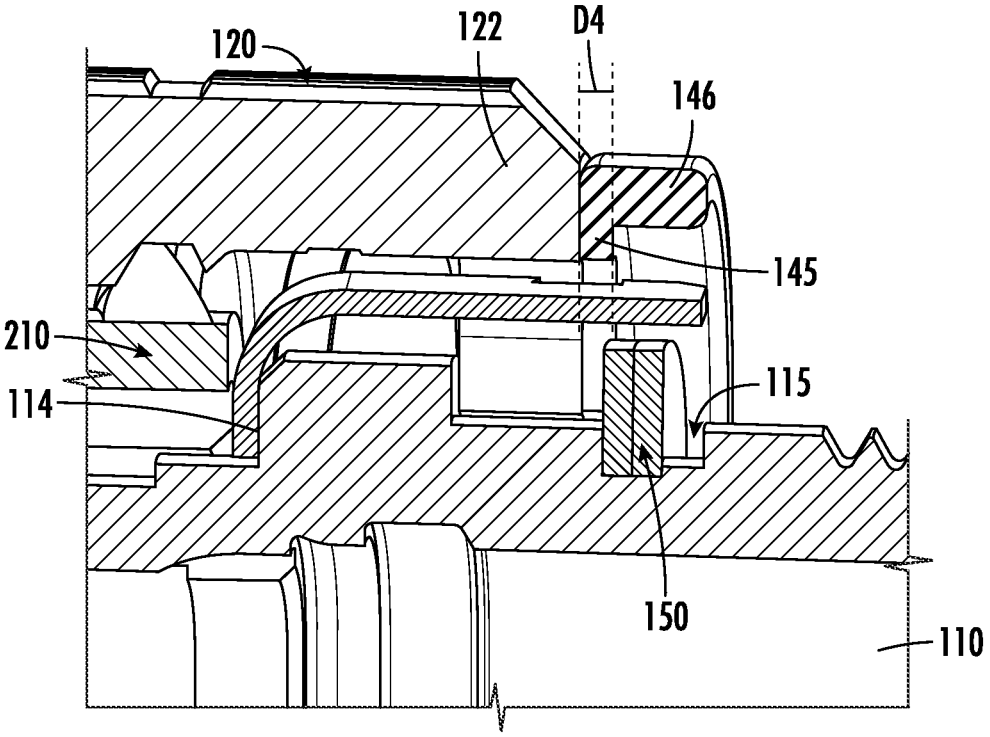
FIG. 10 is another partial cross-sectional view of another portion of the fully-mated electrical connector assembly of FIG. 8.

FIG. 8 illustrates an electrical connector assembly 300 including fully-mated electrical connector 100 and electrical connector 200. FIG. 9 illustrates a portion of fully-mated electrical connector assembly 300. FIG. 10 illustrates another portion of fully-mated electrical connector assembly 300. When the electrical connectors 100 and 200 are in the fully-mated state, there is no gap between the pinching surface 214 and the clamp ring 132, and the clamp ring 132 is clamped or pinched by the pinching surface 114 of the electrical connector 100 and the pinching surface 214 of the electrical connector 200. When the electrical connector 100 and 200 are in the fully-mated state, the clamp ring 132 is clamped or pinched by the pinching surface 114 of the electrical connector 100 and the pinching surface 214 of the electrical connector 200, and indicator 130 is in a non-rotatable state or is not rotated with respect to the connector body 110 under the applied rotation force. That is, the electrical connectors 100 and 200 are in the fully-mated state, if the check member 141 does not rotate when the rotation force is applied thereto by the user. Accordingly, the indicator 130 is non-rotatable or stationary with respect to the connector body 110.

Accordingly, by applying the rotation force (torque) to the check member 141, it can be determined whether the electrical connectors 100 and 200 are in the fully-mated state, according to whether the indicator 130 is in a stationary or non-rotatable state. If the indicator 130 is not rotatable under the rotation force applied by the user, the electrical connectors 100 and 200 are in the fully-mated state. If the indicator 130 is rotatable under the rotation force, the electrical connectors 100 and 200 are not in the fully-mated state indicating to the user that the connectors 100 and 200 need further tightening.

Referring to FIG. 8, the check member 141 is external to the coupling nut 120, and external to the rear end 122 of the coupling nut 120, and thus visible and accessible (e.g., touchable) to the user; and the clamp member 131 extends from an inner location inside the coupling nut 120 to the check member 141 external to the rear end 122 of the coupling nut 120. The projection structures 134 extend from the clamp ring 132 to the check member 141 that is external to the rear end 122 of the coupling nut 120. Further, the projection structures 134 couple the clamp ring 132 to the check member 141. The clamp ring 132 is directly adjacent to the pinching surface 114 of the shoulder 113 of the electrical connector 100. The two slot 142 of the check member 141 are coupled to the two projection structures 134, respectively. The indicator 130 surrounds the connector body 110. In some examples, an outer diameter D3 of indicator 130 may be smaller an outer diameter D4 of the coupling nut 120, the length of the indicator 130 may be smaller than the length of the electrical connector body 110 along a longitudinal axis of the electrical connector body 110, so as to have a compact configuration. In other examples, the outer diameter of indicator 130 may be equal to or larger than the outer diameter of the coupling nut 120. Sizes of the outer diameter and the length of the indicator 130 may be chosen according to various application scenarios.

Referring to FIG. 9, the shoulder 113 is sized and shaped, such that in the fully-mated state, there is a gap with a size D3 between the pinching surface 114 of the shoulder 113 and the pinching surface 214 of the electrical connector 200. The size D3 of the gap between the pinching surface 114 and the pinching surface 214 may be equal to, approximately equal to, or slightly smaller than the thickness of the clamp ring 132 in the axial direction A1 of the clamp ring 132, such that the clamp ring 132 is clamped (or pinched) between and in contact with the pinching surface 114 of the shoulder 113 and the pinching surface 214 of the electrical connector 200, when the electrical connectors 100 and 200 are in the fully-mated state. For example, the length L1 of the shoulder 113 along the longitudinal axis of the connector body 110 may be adjusted or shortened, such that, in the fully-mated state, there is a gap with a size D3 between the pinching surface 114 of the shoulder 113 and the pinching surface 214 of the electrical connector 200.

Referring to FIG. 10, the coupling nut 120 is sized and shaped, such that in the fully-mated state, there is a distance D4 between the rear end 122 of the coupling nut 120 and the annular groove 115. The distance D4 between the rear end 122 of the coupling nut 120 and the annular groove 115 may be equal to approximately equal to the thickness of the base 145 of the check member 141. For example, the rear end 122 of the coupling nut 120 may be a shortened portion, so as to make room or space for the base 145 of the check member 141 and preserve the length of the connector body 110 along the longitudinal direction of the connector body 110. In the example of FIG. 10, the electrical connectors 100 and 200 are in the fully-mated state, and the base 145 of the check member 141 is between the rear end 122 of the coupling nut 120 and the retaining ring 150.

In the example of FIG. 5, the indicator 130 includes the clamp member 131 and the check member 141 that are two pieces coupled to each other. In other examples, the indicator 130 is a unitary piece including the clamp member 131 and the check member 141. For example, the check member 141, the projection structures 134 and the clamp ring 132 are one unitary piece, provided the connector body 110 and coupling nut 120 can be assembled. In certain examples, the coupling nut may be a front loaded coupling nut, the indicator 130 may be a unitary piece and may be installed from the front end 111 of the connector body 110, and further a front loaded coupling nut can be installed from the front end 111 of the connector body 110. In another example, the connector body 110 may be a 2-piece assembly, such that the connector body 110 and coupling nut 120 can be assembled with the unitary indicator.

In another example, the projection structures 134 are one unitary cylindrical or approximately cylindrical piece between the check member 141 and the clamp ring 132. In other embodiments, the projection structures 134 include multiple connections between the check member 141 and the clamp ring 132.

In some examples, the check member 141 is a ring or has a ring-shape. In other examples, the check member 141 can be one or more protrusions or tabs. In some examples, the clamp member 131 includes the clamp ring 132 and the projection structures 134. In other examples, the clamp member 131 includes one or more pieces (such as tabs) that can be clamped between the pinching surface 114 of the electrical connector 100 and the pinching surface 214 of the electrical connector 200 and the projection structures 134 extending from the one or more pieces. When the connector 100 is fully mated to the mating connector 200, the one or more pieces are clamped or pinched by the pinching surface 114 of the electrical connector 100 and the electrical connector 200, and the check member 141 coupled to the clamp member 131 is in a non-rotatable state. Accordingly, by checking whether the check member 141 is in a non-rotatable state, a user can determine whether the connector 100 is in the mated position.

Figure 11:
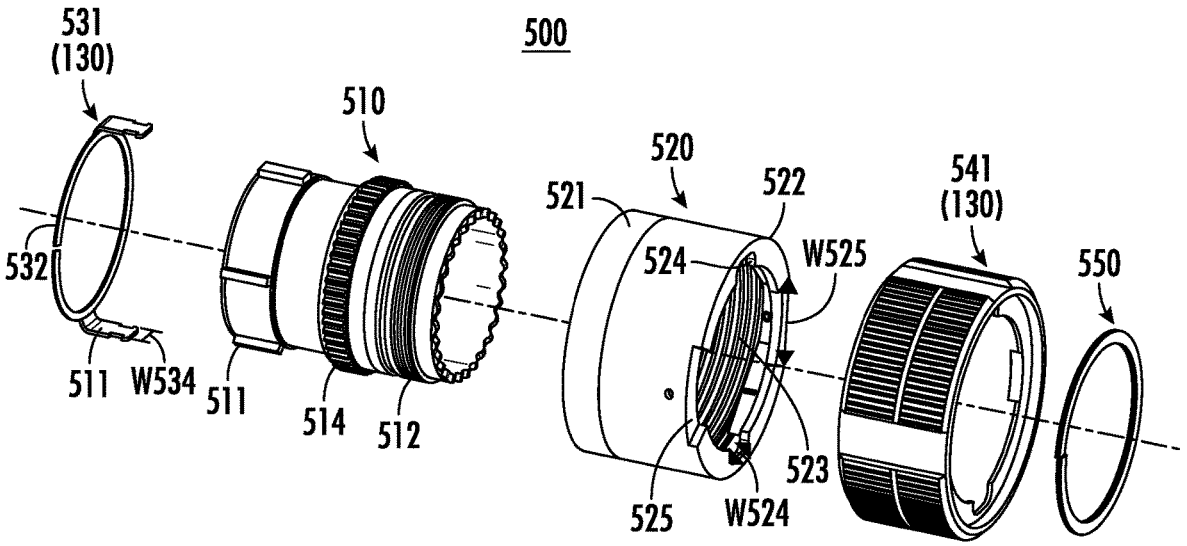
FIG. 11 illustrates an exploded view of another exemplary electrical connector.
Figure 12A:
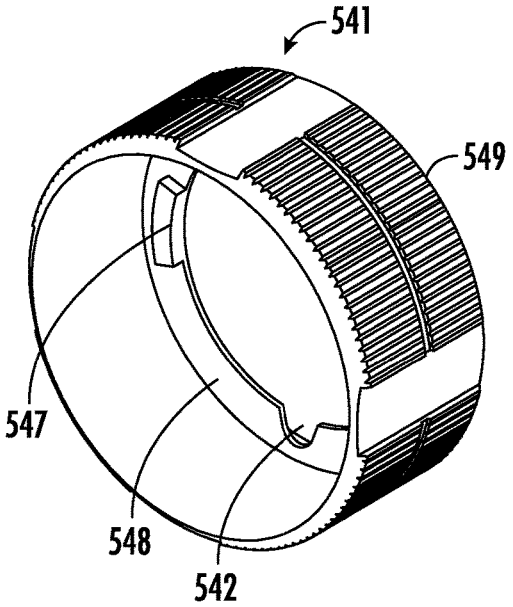
FIGS. 12A and 12B illustrate perspective views of a check member of the electrical connector shown in FIG. 11.
Figure 12B:
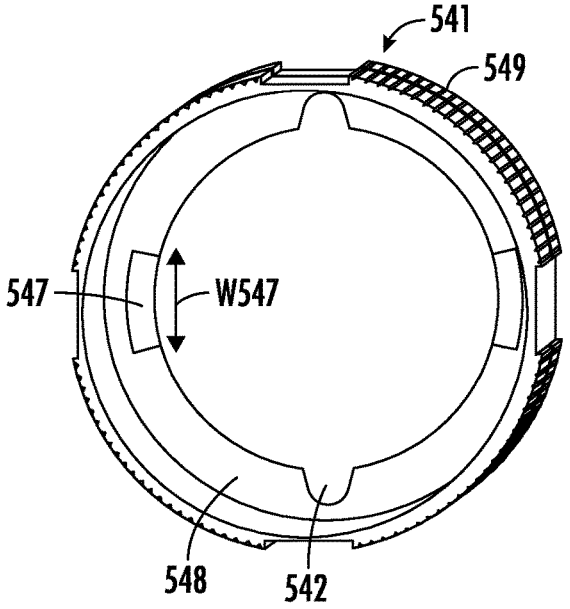
Figure 13:
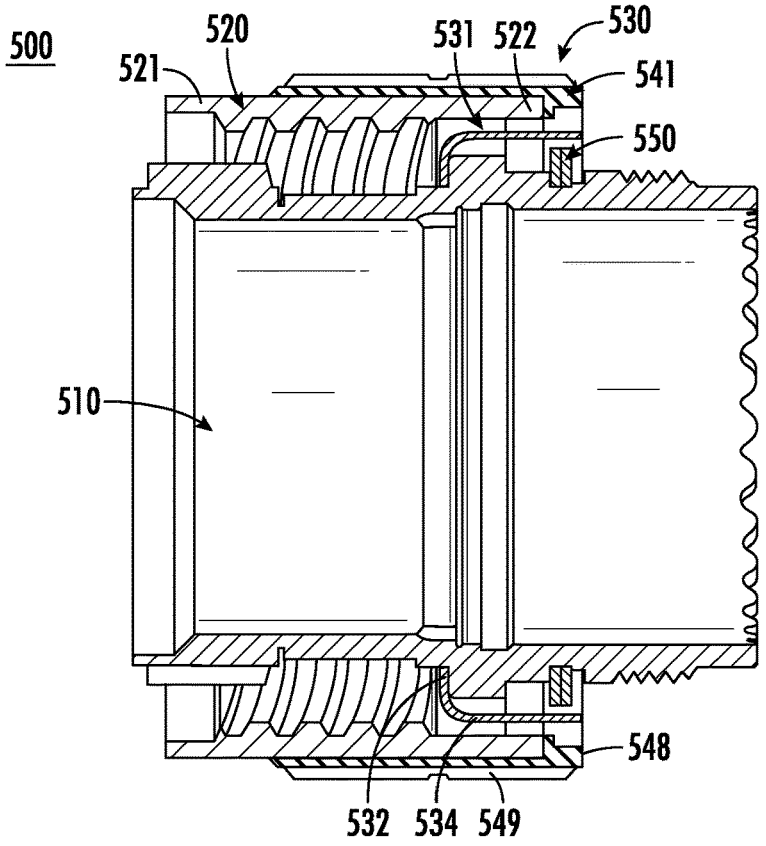
FIG. 13 illustrates a cross-sectional view of the electrical connector shown in FIG. 11.

FIG. 11 illustrates an exploded view of another exemplary electrical connector 500. FIGS. 12A and 12B illustrate perspective views of a check member 541 of the electrical connector 500 shown in FIG. 11. FIG. 13 illustrates a cross-sectional view of the electrical connector 500 after the electrical connector 500 is assembled. The electrical connector 500 (e.g., plug connector) includes a connector body (e.g., a connector shell) 510 and a coupling nut 520. The coupling nut 520 is configured to at least partially surround the connector body (e.g., a connector shell) 510, when the electrical connector 500 is assembled. The connector body 510 includes a front end 511, a rear end 512, and a shoulder 513. The coupling nut 520 includes a front end 521 (e.g., a first end), a rear opposing end 522 (e.g., a second end), and an inner thread portion 523 located between the front end 521 and rear end 522. The inner thread portion 523 includes inner threads configured to mate with outer threads of a mating connector (e.g., receptacle connector 600 in FIG. 14). The front end 521 of the coupling nut 520 may be configured to interface with a complementary electrical connector (e.g., a receptacle connector 600 in FIG. 14). Certain components or features of the electrical connector 500 are the same as or similar to the above-described electrical connector 100, and references can be made to the above description, such as the description associated with the electrical connector 100.

Figure 14:
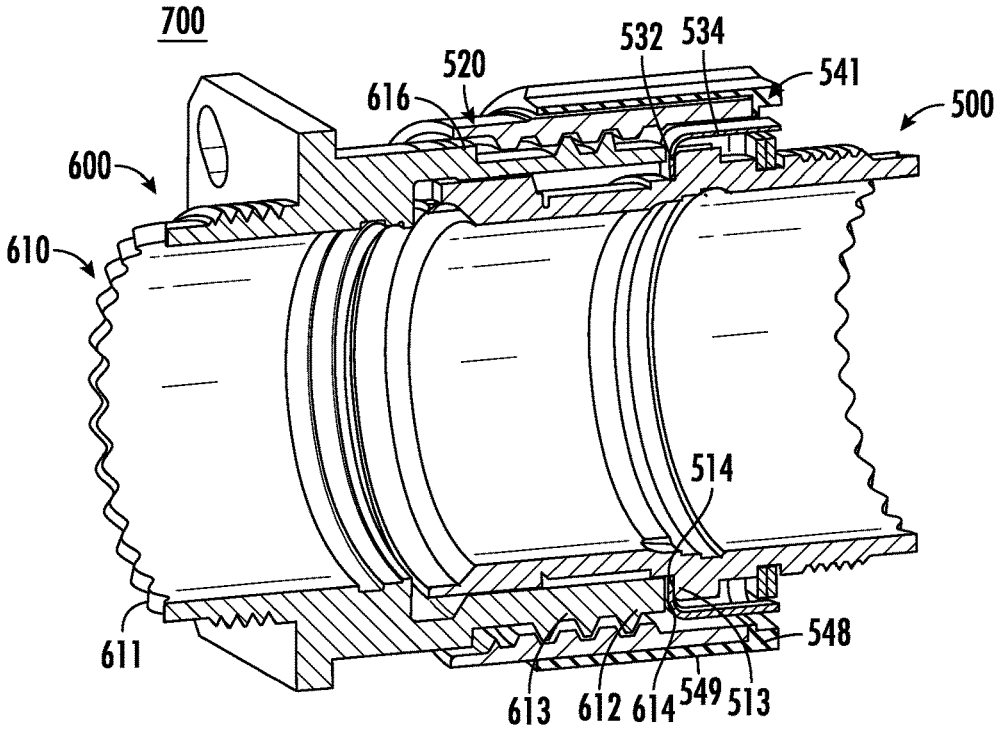
FIG. 14 illustrates a perspective cross-sectional view of an electrical connector assembly including fully-mated electrical connector of FIG. 11 and a mating electrical connector.

The electrical connector 500 further includes an indicator 530 configured to assist a user in determining a tightness of mating between the electrical connector 500 and the corresponding mating connector (e.g., a receptacle connector 600 in FIG. 14). For example, indicator 530 may be configured to assist a user in determining whether the electrical connector 500 is in a fully-mated state (i.e., full-mate state) with respect to the corresponding mating connector; and accordingly, in some examples, the indicator 530 is a full-mate indicator that determines whether the associated electrical connector (e.g., connector body 510 and coupling nut 520) is in a fully-mated state with respect to the mating connector (e.g., receptacle connector 600 in FIG. 14). The indicator 530 may include a clamp member 531 and a check member 541 coupled to the clamp member 531. The clamp member 531 includes a clamp ring 532 and projection structures or arms 534 extending from the clamp ring 532. The check member 541 is configured to be visible to and accessible (e.g., touchable) by the user of the connector 500, e.g. an installer, to readily indicate to the user whether the connector 500 is fully mated to the corresponding mating connector 600 (see e.g., FIG. 14 showing the connector in a fully mated position).

The electrical connector 500 further includes a retaining ring 550 configured to retain components (e.g., the coupling nut 520 and the check member 541) of the electrical connector 500 in place with respect to the connector body 510 when the electrical connector 500 is assembled. The retaining ring 550 is the same as or similar to the above-described retaining ring 150, and references can be made to the above description, such as the description associated with the retaining ring 150.

Referring to FIGS. 11 to 13, the coupling nut 520 further includes one or more clearance apertures 524 (e.g., clearance slots) and one or more receiving grooves 525 at the rear end 522. The clearance aperture 524 has width W524 and provides clearance, such that the projection structure 534 can extend to the check member 541, the indicator 530 may rotate under rotation force when the electrical connector 500 is not fully mated with a mating connector. The receiving grooves 525 have widths W525. The check member 541 of the indicator 530 includes a ring portion 548, a sleeve 549 extending from the ring portion 548, and one or more bulge members 547 extending from a surface of the ring 548. The ring portion 548 has slots 542. The ring portion 548 and slots 542 are the same as or similar to above-described features of the check member 141, and references can be made to the above description, such as the description associated with the check member 141.

The one or more receiving grooves 255 are configured to receive the one or more bulge members 547, respectively. When the bulge members 547 of the indicator 530 are in the receiving grooves 255 of the coupling nut 520, by applying coupling force (or torque) to the check member 541 of the indicator 530, the bulge members 547 of the indicator 530 can drive the coupling nut 520 to rotate, so as to couple the coupling nut 520 to a complementary electrical connector (e.g., a receptable connector 600 in FIG. 14). When the bulge members 547 of the indicator 530 are in the receiving grooves 255 of the coupling nut 520, by applying decoupling force (or torque) to the check member 541 of the indicator 530, the bulge members 547 of the indicator 530 can drive the coupling nut 520 to rotate, so as to decouple the coupling nut 520 from the complementary electrical connector.

The receiving groove 255 has a width W525 that is larger than width W547 of the bulge members 547, and accordingly provide clearance for the bulge members 547 and the indicator 530 to rotate (e.g., back and forth) under a rotation force or torque when the electrical connector 500 is not in a fully-mated state with respect to the complementary electrical connector. When the electrical connector 500 is in the fully-mated state with respect to the complementary electrical connector, the clamp ring 532 is clamped or pinched between the shoulder 513 of the electrical connector 500 and the complementary electrical connector, and accordingly, the indicator 530 cannot rotate under a rotation force or torque. The indicator 530 can assist a user in determining whether the electrical connector 500 is in a fully-mated state with respect to the complementary electrical connector.

The clearance aperture 524 of the coupling nut 520 has a width W524 that is larger than a width W534 of the respective projection structure or arm 534, and accordingly provides clearance for the projection structure or arm 534 to extend from the clamp ring 532 to the check member 541, and provides clearance for the projection structure or arm 534 and the indicator 530 to rotate (e.g., back and forth) under a rotation force or torque when the electrical connector 500 is not in a fully-mated state with respect to the complementary electrical connector. In some examples, by applying coupling force (or torque) or decoupling force (or torque) to the check member 541 of the indicator 530, the projection structures or arms 534 may be used to drive the coupling nut 520 to rotate, so as to couple the coupling nut 520 to a complementary electrical connector (e.g., a receptable connector 600 in FIG. 14) or decouple the coupling nut 520 from the complementary electrical connector, respectively.

The sleeve 549 may extend in or parallel to a direction pointing from the rear end 522 towards the front end 521 of the coupling nut 520, and at least partially cover or surround the coupling nut 520. Rotation force (or torque) may be applied to the sleeve 549 of the indicator 530, to assist a user in determining whether the electrical connector 500 is in a fully-mated state with respect to the complementary electrical connector. The sleeve 549 may have patterns (such as stripes) at its outer surface, so as to roughen the outer surface and facilitate applying force (or torque) to the sleeve 549.

FIG. 14 illustrates a perspective cross-sectional view of an electrical connector assembly 700 including fully-mated electrical connector 500 and electrical connector 600. The mating electrical connector 600 (e.g., socket connector) includes a connector body 610 (e.g., a shell). The connector body 610 includes a rear end 611, a front end 612, a thread portion 613 including outer threads, and a pinching surface 614. The pinching surface 614 faces toward the electrical connector 500, when the two electrical connectors 500, 600 being mated with each other to form the electrical connector assembly 700. When the electrical connector 500 is mated with the electrical connector 600, the coupling nut 520 of the electrical connector 500 is advanced over the outer threads of the thread portion 613 of the second electrical connector 600 via, e.g., applying coupling force (or torque) to the check member 541 of the indicator 530.

The electrical connector 600 may include a band 616 (See, e.g., FIG. 14). The band 616 is configured at suitable location, such that it is exposed from and not covered by the coupling nut 520 of the electrical connector 500 before the electrical connector 600 is mated with the electrical connector 500. The band 616 may have certain color, such as red color, to assist the user in determining whether the band 616 is exposed.

In some examples, when the two electrical connectors 500 and 600 are partially mated to a state that their electrical contacts (not shown in FIG. 14) have electrical engagement but the two electrical connectors 500 and 600 are not fully mated or when the two electrical connectors 500, 600 are fully mated, the band 616 is covered by the coupling nut 520 of the electrical connector 500. Accordingly, according to whether the band 616 is exposed from the coupling nut 520 of the electrical connector 500, the user can determine whether the electrical connector 600 is unmated with the electrical connector 500. However, whether the electrical connector 600 is fully mated with the electrical connector 500 may not be determined according to whether the band 616 is covered by the coupling nut 520 of the electrical connector 500.

The indicator 530 can assist a user in determining whether the electrical connector 500 is in a fully-mated state with respect to the electrical connector 600. When the electrical connectors 500 and 600 are in the fully-mated state (see, e.g., FIG. 14), there is no gap between the pinching surface 614 and the clamp ring 532, and the clamp ring 532 is clamped or pinched by a pinching surface 514 of the shoulder 513 of the electrical connector 500 and the pinching surface 614 of the electrical connector 600. When the electrical connector 500 and 600 are in the fully-mated state, the clamp ring 532 is clamped or pinched by the pinching surface 514 of the electrical connector 500 and the pinching surface 614 of the electrical connector 600, and indicator 530 is in a non-rotatable state or is not rotated with respect to the connector body 510 under the applied rotation force (or torque) to the sleeve 549 of the check member 541. That is, the electrical connectors 500 and 600 are in the fully-mated state, if the check member 541 does not rotate when the rotation force or torque is applied thereto by the user. Accordingly, the indicator 530 is non-rotatable or stationary with respect to the connector body 510.

When the electrical connectors 500 and 600 are not fully-mated, e.g., in a partially-mated state or an unmated state, the clamp ring 532 is not clamped or pinched, or is only partially clamped or pinched, by the pinching surface 514 of the electrical connector 500 and the pinching surface 614 of the electrical connector 600. Under rotation force or torque applied by the user to the sleeve 549 of the check member 541, the check member 541 rotates; and as the check member 541 is coupled to the clamp ring 532 via the projection structures 534, the clamp ring 532 and the projection structures 534 rotate together with the check member 541. Accordingly, the indicator 530 is in a rotatable state or is rotated from a first position to a second position with respect to the connector body 510, or rotated back and forth between the first and second positions, in response to the rotation force or torque. In some examples, the indicator 530 may be rotated by an angle in, e.g., a range of −4 degrees to +4 degrees with respect to the connector body 510, in response to the rotation force or torque. Various ranges of rotation angle can be configured by choosing suitable widths W525 of grooves 525 and suitable widths W547 of bulge members 547, and/or by choosing suitable widths W524 of clearance apertures 524 and suitable widths W534 of the projection structures or arms 534.

Figure 15A:
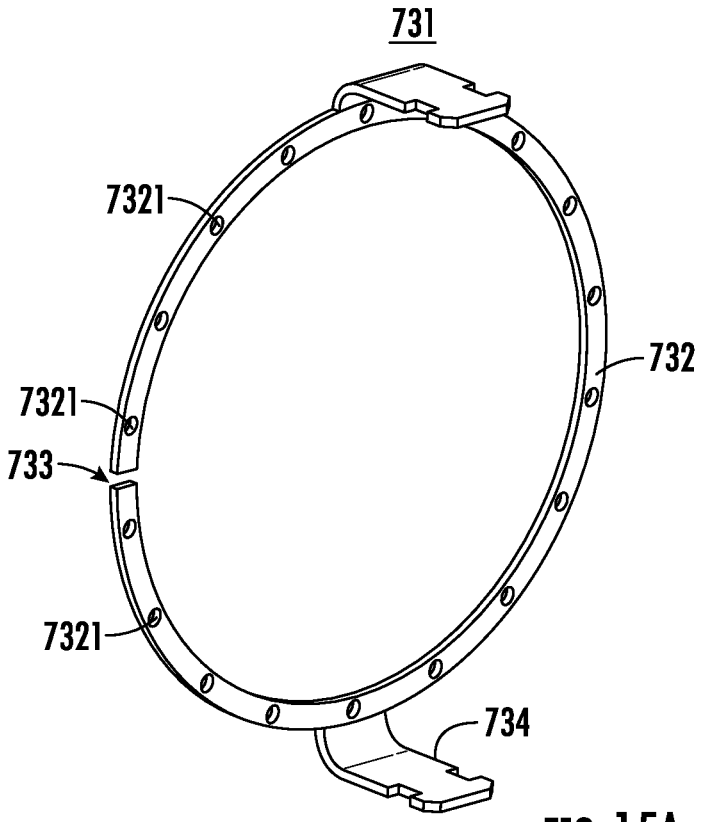
FIGS. 15A and 15B illustrate perspective views of another example clamp member.
Figure 15B:
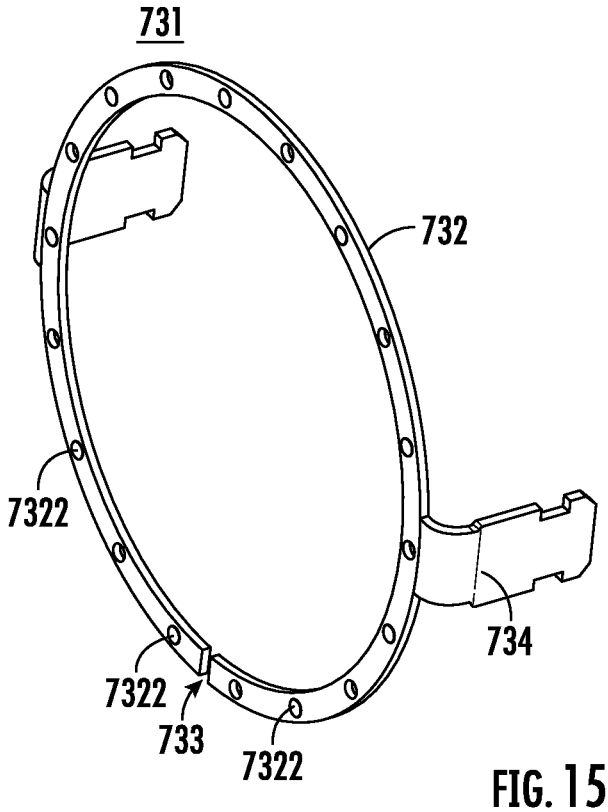

FIGS. 15A and 15B illustrate perspective views of another example clamp member 731. The example clamp member 731 can be coupled to or integrated with a check member (such as 141, 541) to form an indicator consistent with the present disclosure. The clamp member 731 includes a clamp ring 732 and projection structures or arms 734 extending from the clamp ring 732. The projection structures or arms 734 are the same as or similar to the above-described projection structures or arms (such as 134, 534), and references can be made to the above descriptions. The clamp ring 732 has a split portion 733, and includes or is attached with alternating bumps 7321, 7322 on two opposite surfaces of the clamp ring 732. The bumps 7321 may protrude in an opposite direction as compared to the bumps 7322.

When the electrical connector of the clamp ring 732 and a corresponding mating connector are fully mated, the clamp ring 732 having the bumps 7321 and 7322 is clamped or pinched by pinching surfaces of the electrical connector of the clamp ring 732 and the corresponding mating connector, and the bumps 7321, 7322 can concentrate the applied force onto a discrete number of locations at the surfaces of the clamp ring 732 and the pinching surfaces of the electrical connector and the corresponding mating connector. Accordingly, concentrated wiping action can be obtained, and electrical conduction (e.g., grounding conduction) between the pinching surfaces of the electrical connector and the corresponding mating connector can be improved. Wiping action refers to sliding action between the two conductors under mechanical load (such as force applied normal to the plane of the surfaces of the two conductors), and such sliding action tends to displace non-conductive particles or films, such as grease or oxide, and can improve the reliability of the electrical junction.

Further, when the electrical connector of the clamp ring 732 and the corresponding mating connector are fully mated, the clamp ring 732 is clamped or pinched by pinching surfaces of the electrical connector of the clamp ring 732 and the corresponding mating connector, and, with bumps 7321 and 7322, the clamp ring 732 may be deflected or bent under the applied force, resulting in residual static spring force between the electrical connector and the corresponding mating connector to facilitate locking functionality.

Figure 16A:
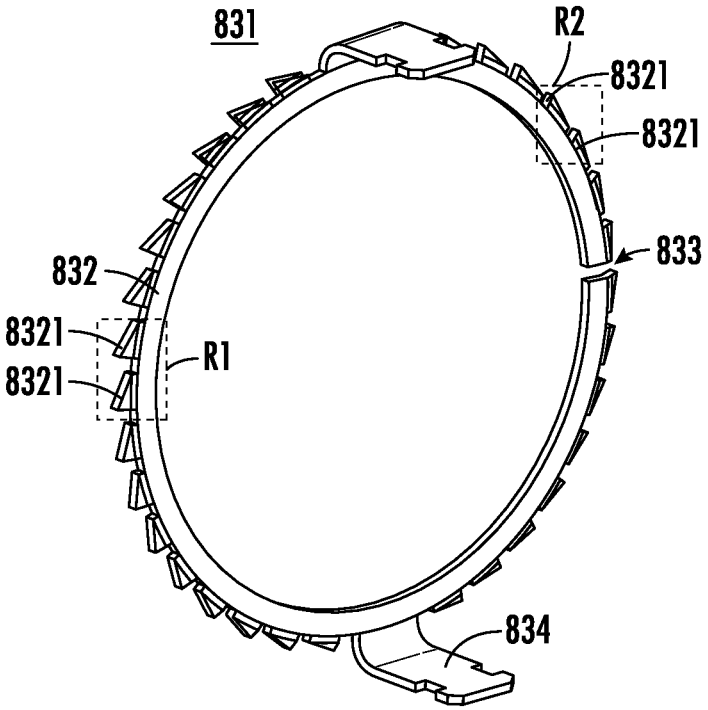
FIGS. 16A and 16B illustrate perspective views of another example clamp member.
Figure 16B:
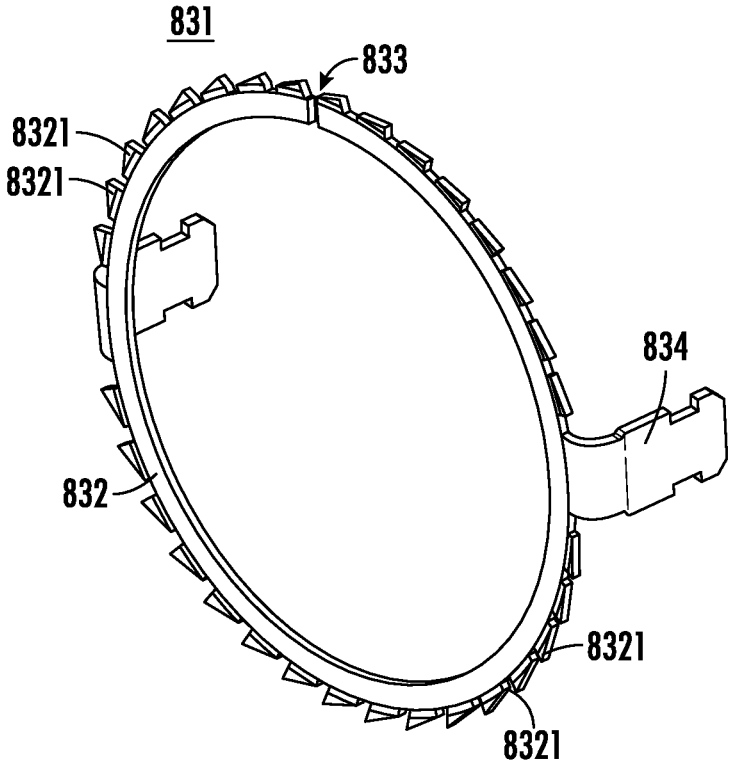

FIGS. 16A and 16B illustrate perspective views of another example clamp member 831. The example clamp member 831 can be coupled to or integrated with a check member (such as 141, 541) to form an indicator consistent with the present disclosure. The clamp member 831 includes a clamp ring 832 and projection structures or arms 834 extending from the clamp ring 832. The projection structures or arms 834 are the same as or similar to the above-described projection structures or arms (such as 134, 534), and references can be made to the above descriptions. The clamp ring 832 has a split portion 833, and includes or is attached with serrations 8321 surrounding the periphery of the clamp ring 832. The serrations 8321 may protrude from the periphery of the clamp ring 832 towards two sides of the clamp ring 832. For example, serrations 8321 in region R1 protrude towards a same side of the clamp ring 832 as compared to the projection structures or arms 834, but serrations 8321 in region R2 protrude towards an opposite side of the clamp ring 832 as compared to the projection structures or arms 834.

When the electrical connector of the clamp ring 832 and a corresponding mating connector are fully mated, the clamp ring 832 having serrations 8321 is clamped or pinched by pinching surfaces of the electrical connector of the clamp ring 832 and the corresponding mating connector, and the serrations 8321 can concentrate the applied clamp force onto a discrete number of locations at the clamp ring 832 and the pinching surfaces of the electrical connector and the corresponding mating connector. Accordingly, concentrated wiping action can be obtained, and electrical conduction (e.g., grounding conduction) between the pinching surfaces of the electrical connector and corresponding mating connector can be improved.

Further, when the electrical connector of the clamp ring 832 and the corresponding mating connector are fully mated, the clamp ring 832 having serrations 8321 is clamped or pinched by pinching surfaces of the electrical connector of the clamp ring 832 and the corresponding mating connector, and individual serrations 8321 may be deflected or bent under the applied force, resulting in residual static spring force between the electrical connector and the corresponding mating connector to facilitate locking functionality.

The serration 8321 may have a asymmetric shape to further facilitate locking functionality. The serrations and may project towards the outside of the periphery of the clamp ring 832 (as shown in FIGS. 16A and 16B) or towards the inside of the periphery of the clamp ring 832, or both.

In other examples, the bumps or serrations may protrude from only one side of the clamp ring (e.g., 732, 832). In yet other examples, the clamp member (e.g., 731, 831) may include other features protruding from the clamp ring (e.g., 732, 832), in addition to or in place of bumps or serrations, to improve electrical conduction (e.g., grounding conduction) between the pinching surfaces of the electrical connector and the corresponding mating connector. For example, in some embodiments, the clamp ring (e.g., 732, 832) includes a knurled surface or other non-linear feature protruding from the clamp ring (e.g., 732, 832). In yet another example, the clamp ring or a portion of the clamp ring may include a non-linear profile (e.g., a wavy profile) in addition to or in place of the protruding features to improve electrical conduction between the pinching surfaces of the electrical connector and the corresponding mating connector.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples, and various combinations of examples not specifically described or illustrated herein that are still within the scope of this disclosure may be used. In this respect, it is to be understood that the disclosure is not limited to the specific examples set forth and the examples of the disclosure are intended to be illustrative, not limiting.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as front, rear, etc. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

What is claimed is:

1. An electrical connector, comprising:

a connector shell comprising a shoulder having a pinching surface;

a coupling nut configured to at least partially surround the connector shell, wherein the coupling nut includes a first end and a second end opposite the first end, and the first end is configured to interface with a mating connector; and an indicator including a clamp member and a check member; wherein:

the check member is external to the coupling nut, and the clamp member extends from an inner location inside the coupling nut to the check member, the clamp member includes a ring for pinching between the pinching surface of the shoulder and the mating connector, and the ring has at least one of bumps protruding in opposite directions and serrations surrounding a periphery of the ring.

2. The electrical connector of claim 1, wherein the check member is movable with respect to the connector shell when the electrical connector is in an unmated state or a partially-mated state.

3. The electrical connector of claim 1, wherein:

the check member includes a ring portion, a sleeve extending from the ring portion, and one or more bulge members extending from a surface of the ring portion; and the coupling nut further includes one or more receiving grooves configured to receive the one or more bulge members, respectively.

4. The electrical connector of claim 1, wherein:

the indicator is in a non-rotatable state when the electrical connector is in a fully-mated state with respect to the mating connector, and the indicator is in a rotatable state when the electrical connector is in an unmated state or a partially-mated state with respect to the mating connector.

5. The electrical connector of claim 1, wherein:

at least a portion of the clamp member is positioned adjacent to the pinching surface of the shoulder for pinching between the pinching surface of the shoulder and the mating connector.

6. The electrical connector of claim 5, wherein:

the check member includes one or more slots;

the coupling structure includes one or more projection structures each having an end portion and a neck portion; and the one or more slots of the check member are coupled to the one or more projection structures, respectively.

7. The electrical connector of claim 6, wherein:

the end portion of one of the one or more projection structures has a larger width than one of the one or more slots of the check member; and the neck portion of one of the one or more projection structures has a smaller width than one of the one or more slots of the check member.

8. The electrical connector of claim 1, wherein the clamp member also includes a coupling structure extending from the ring to the check member to couple the ring to the check member.

9. The electrical connector of claim 8, wherein the ring is circular or configured to interface with a circular pinching surface of the connector shell.

10. The electrical connector of claim 8, wherein the ring has a split portion.

11. The electrical connector of claim 1, wherein the check member is stationary with respect to the connector shell when the electrical connector is in a fully-mated state.

12. The electrical connector of claim 11, wherein the clamp member is located adjacent to a shoulder of the connector shell such that the clamp member is clamped between the shoulder and the mating connector when the electrical connector is in a fully-mated state.

13. The electrical connector of claim 6, wherein the second end of the coupling nut includes one or more clearance apertures corresponding to the one or more projection structures, respectively.

14. The electrical connector of claim 13, wherein one of the one or more clearance apertures has a larger width than the end portion of one of the one or more projection structures.

15. An electrical connector, comprising:

a connector shell;

a coupling nut; and an indicator surrounding the connector shell, wherein the indicator includes a clamp member that is at least partially internal to the coupling nut and a check member that is external to the coupling nut, wherein:

the clamp member includes a ring and a coupling structure extending from the ring to the check member, wherein the connector shell includes a shoulder having a pinching surface, the ring is adjacent to the pinching surface of the shoulder, the check member includes one or more slots, the coupling structure includes one or more projection structures each having an end portion and a neck portion, and the one or more slots of the check member are coupled to the one or more projection structures, respectively.

16. An electrical connector, comprising:

a connector shell;

a coupling nut configured to at least partially surround the connector shell, wherein the coupling nut includes a first end and a second end opposite the first end, and the first end is configured to interface with a mating connector; and an indicator including a clamp member and a check member;

wherein:

the check member is external to the coupling nut, and the clamp member extends from an inner location inside the coupling nut to the check member, the check member includes a ring portion, a sleeve extending from the ring portion, and one or more bulge members extending from a surface of the ring portion; and the coupling nut further includes one or more receiving grooves configured to receive the one or more bulge members, respectively.

17. The electrical connector of claim 16, wherein:

the connector shell includes a shoulder having a pinching surface; and at least a portion of the clamp member is positioned adjacent to the pinching surface of the shoulder for pinching between the pinching surface of the shoulder and the mating connector.

18. The electrical connector of claim 16, wherein the clamp member includes a ring for pinching between the pinching surface of the shoulder and the mating connector, and the clamp member also includes a coupling structure extending from the ring to the check member to couple the ring to the check member.

19. The electrical connector of claim 16, wherein the check member is stationary with respect to the connector shell when the electrical connector is in a fully-mated state.

20. The electrical connector of claim 16, wherein the check member is movable with respect to the connector shell when the electrical connector is in an unmated state or a partially-mated state.

* * * * *